US007611331B2

(12) United States Patent
Hoefling et al.

(10) Patent No.: US 7,611,331 B2
(45) Date of Patent: Nov. 3, 2009

(54) DEVICE AND METHOD FOR CONTROLLING A TWO CYLINDER THICK MATTER PUMP

(75) Inventors: Stefan Hoefling, Selingenstadt (DE); Wilhelm Hofmann, Niederdorfelden (DE); Wolf-Michael Petzold, Aichwald (DE)

(73) Assignee: Putzmeister Concrete Pumps GmbH, Aichtal (DE)

( * ) Notice: Subject to any disclaimer, the term of this patent is extended or adjusted under 35 U.S.C. 154(b) by 392 days.

(21) Appl. No.: 10/592,217

(22) PCT Filed: Mar. 18, 2005

(86) PCT No.: PCT/EP2005/002895

§ 371 (c)(1),
(2), (4) Date: Sep. 8, 2006

(87) PCT Pub. No.: WO2005/093252

PCT Pub. Date: Oct. 6, 2005

(65) Prior Publication Data

US 2007/0196219 A1 Aug. 23, 2007

(30) Foreign Application Priority Data

Mar. 26, 2004 (DE) ..... 10 2004 015 415

(51) Int. Cl.
*F04B 49/00* (2006.01)
*F04B 35/02* (2006.01)

(52) U.S. Cl. ..... 417/12; 417/46; 417/53; 417/347; 417/900

(58) Field of Classification Search ..... 417/12, 417/46, 342, 347, 532, 900, 53
See application file for complete search history.

(56) References Cited

U.S. PATENT DOCUMENTS

| | | | | | |
|---|---|---|---|---|---|
| 4,569,642 | A | * | 2/1986 | Dwyer | 417/516 |
| 5,238,371 | A | * | 8/1993 | Benckert | 417/345 |
| 5,330,327 | A | | 7/1994 | Anderson | |
| 5,332,366 | A | * | 7/1994 | Anderson | 417/63 |
| 5,336,055 | A | * | 8/1994 | Anderson | 417/63 |
| 5,401,140 | A | | 3/1995 | Anderson | |

FOREIGN PATENT DOCUMENTS

| | | |
|---|---|---|
| DE | 32 43 576 A1 | 5/1984 |
| DE | 195 42 258 A1 | 5/1997 |
| EP | 0 562 398 A1 | 9/1993 |
| EP | 0 567 826 A2 | 11/1993 |

* cited by examiner

*Primary Examiner*—Charles G Freay
(74) *Attorney, Agent, or Firm*—Patent Central LLC; Stephan A. Pendorf

(57) ABSTRACT

A device and a method for controlling a two-cylinder thick matter pump comprising pistons that are actuated in a push-pull manner by means of a hydraulic reversible pump (6) and hydraulic drive cylinders controlled by said pump. To ensure a reliable operation of the pump the expected length of the stroke of the pistons (8, 8') in the drive cylinders (5, 5') is measured and recorded, the stroke time of each conveyance stroke is monitored and compared with the expected stroke duration, and the reversible pump (6) is respectively pivoted, reversing the flow, and/or the pipe switch (56) is reversed when the stroke time exceeds the expected stroke duration by a pre-determined value.

19 Claims, 3 Drawing Sheets

DEVICE AND METHOD FOR CONTROLLING A TWO CYLINDER THICK MATTER PUMP

CROSS REFERENCE TO RELATED APPLICATION

This application is a national stage of PCT/WO2005/093252 filed Mar. 18, 2005 and based upon DE 10 2004 015 415.5 filed Mar. 26, 2004 under the International Convention.

BACKGROUND OF THE INVENTION

Field of the Invention

The invention concerns a device and a process for controlling a two cylinder thick matter pump with two conveyor cylinders communicating via end openings in a material supply container operable in counter stroke by means of a hydraulic reversible pump and via hydraulic drive cylinders controlled by the pump, with a hydraulic actuated pipe switch provided within the material supply container, of which the inlet side is alternatingly connectable to one of the openings of the conveyor cylinders leaving open the respective other opening and on the outlet side is connected with a conveyor line, wherein at each conveyor stroke the passing-by of the piston is detected at least two sensor positions spaced a predetermined distance from each other and from the rod and/or bottom side end of the drive cylinder, and upon ending of the conveyor stroke initiates a switching process of the reversible pump and the pipe switch, wherein respectively upon conclusion of the one advance stroke a reversal process of the pipe switch is initiated, wherein further the drive cylinders, forming a closed hydraulic circuit, are hydraulically connected with respectively one connection at one of their ends to the reversible pump and to each other via an oscillating hydraulic line at their other end, and wherein hydraulic pressure branched or tapped out of the hydraulic lines leading from the reversible pump to the drive cylinders is used for reversing the pipe switch.

A device for control of a two cylinder thick matter pump of this type is known (DE 195 42 258), in which the end position of the piston of the drive cylinder can be determined by means of cylinder switch sensors for producing end position signals. The flow-through reversal of the reversible pumps is there initiated by the end position signal of the drive cylinder. As a rule the end position signal is conventionally triggered via the two cylinder switch sensors located at the rod end of the cylinder. It often happens that the cylinder switch sensors fail. In such a case it is necessary to switch to manual operation or to turn off the machine.

SUMMARY OF THE INVENTION

Beginning therewith it is the task of the present invention to develop a device and a process, with which, even in the case of failure of the hitherto conventional cylinder switch sensors, a reliable pump operation can be ensured with continuous flow of concrete.

For the solution of this task the combination of characteristics set forth in the main patent claims is proposed. Advantageous embodiments and further developments of the invention can be seen from the dependent claims.

The inventive solution is based primarily upon the recognition, that in consulting a computer control, supplemental operating data can be derived from the hydraulic circuit for control of the reversible pump and the pipe switch.

A first variation of the solution envisions that the reversing device includes a computer assisted device for determining the predicted stroke duration and for the registration thereof in a memory device as well as for monitoring the time during each piston stroke and for initiating a pipe switch control and a reversal of the flow in the reversible pump according to the measure of the defined stroke time, with comparison to an anticipated elapsed stroke duration. Preferably the reversal device therein exhibits a time monitoring routine, which includes an algorithm for determining a comparison value from actual stroke time and predicted stroke duration and to their conversion, upon exceeding a predetermined value, into a reversal signal for the pipe switch and/or the reversible pump. One advantageous embodiment of the invention envisions therein that the reversing device includes an input routine for recording in memory the stroke duration measured during a calibration of the concrete pump with at least one specific defined conveyance amount. Since the conveyed amount can be varied in computer-controlled concrete pumps, for example via a remote control device, it is of particular advantage when the reversing device includes a computer routine for variably converting the registered stroke duration based upon the conveyance amount input from the remote control device.

According to a preferred or alternative embodiment of the invention a sensor is provided for monitoring the hydraulic pressure on the hydraulic pressure side of the reversible pump, which output signal can be evaluated by a pressure monitoring routine of the reversing device for initiating a pipe switch reversal and flow-through reversal of the reversible pump. For this purpose an average pump pressure can be determined and stored in memory during each pressure stroke. The pressure monitoring routine then provides an algorithm for determining the pressure increase occurring at the end of each pressure stroke in the concerned drive cylinder relative to the average pressure value and for the translation thereof into a reversal signal for the pipe switch and/or reversible pump.

If one cylinder switch sensor responsive to the pistons as they pass by is provided respectively spaced apart from the rod end and bottom end of the drive cylinders, then the reversing device can, besides this, include a path monitoring routine responsive to the output signal of the selected cylinder switch sensor for initiating the pipe switch reversal and/or flow-through reversal of the reversible pump. The reversal device can in this case supplementally include a measurement routine for determining the stroke duration from the initiation signals of the cylinder switch sensors and to their recordation. The stroke durations recorded in a memory in this manner can, in emergency cases, be employed for controlling the time of the flow-through reversal.

One preferred embodiment of the invention envisions that on the path monitoring routine corresponding to the selected cylinder switch sensors, the pressure monitoring routine responsive to the pressure measurement values, and the time monitoring routine responsive to the stroke time, can form a, preferably hierarchical structured, redundant program sequence for controlling the pipe switch and/or reversible pump.

The inventive control, in normal operation, switches the reversible pump upon reaching the base side cylinder switch and insures therewith a continuous flow of concrete. At the same time, during operation the respective stroke duration is calculated and the average high pressure at the pressure outlet of the reversible pump is determined and stored in the data storage.

In the case that at least one of the rod side cylinder switch sensors fails, the control for the further operation of the pump can automatically be switched to one of the base side cylinder switch sensors. The rod side cylinder switch sensors are on the one hand given priority. During operation however the rod and the base side cylinder sensors are monitored, and can be activated independently of each other for the above mentioned measuring processes.

In the case that three or all four cylinder switch sensors fail, it is possible with the inventive supplemental measures to monitor the stroke time from the last reversal process and to compare this with the registered stroke duration. The expected stroke duration can be calculated from the conveyed amount, the RPM and the viscosity of the conveyed material. If the stroke time has approximately elapsed, then the high pressure at the pump output is compared with the average stored high pressure of the actual stroke. In the case of an increase of the pressure beyond the predetermined threshold, in this case an override reversal can be initiated.

In so far as the measured stroke time exceeds the registered stroke time and during this time no increase in pressure was determined, a forced or override reversal can occur on the basis of the time measurement alone. Therewith it is ensured that also in the case of a loss of a pressure sensor an automatic further operation of the concrete pump can continue.

For simplification of the pump control the present described measures can also be employed individually for switching over the pipe switch and the reversible pump.

BRIEF DESCRIPTION OF THE DRAWINGS

In the following the invention will be described in greater detail on the basis of the illustrative embodiment shown in schematic manner in the figures. There is shown FIG. 1 A section of a two cylinder thick matter pump in partial sectional perspective representation.

DETAILED DESCRIPTION OF THE INVENTION

Figure 1:
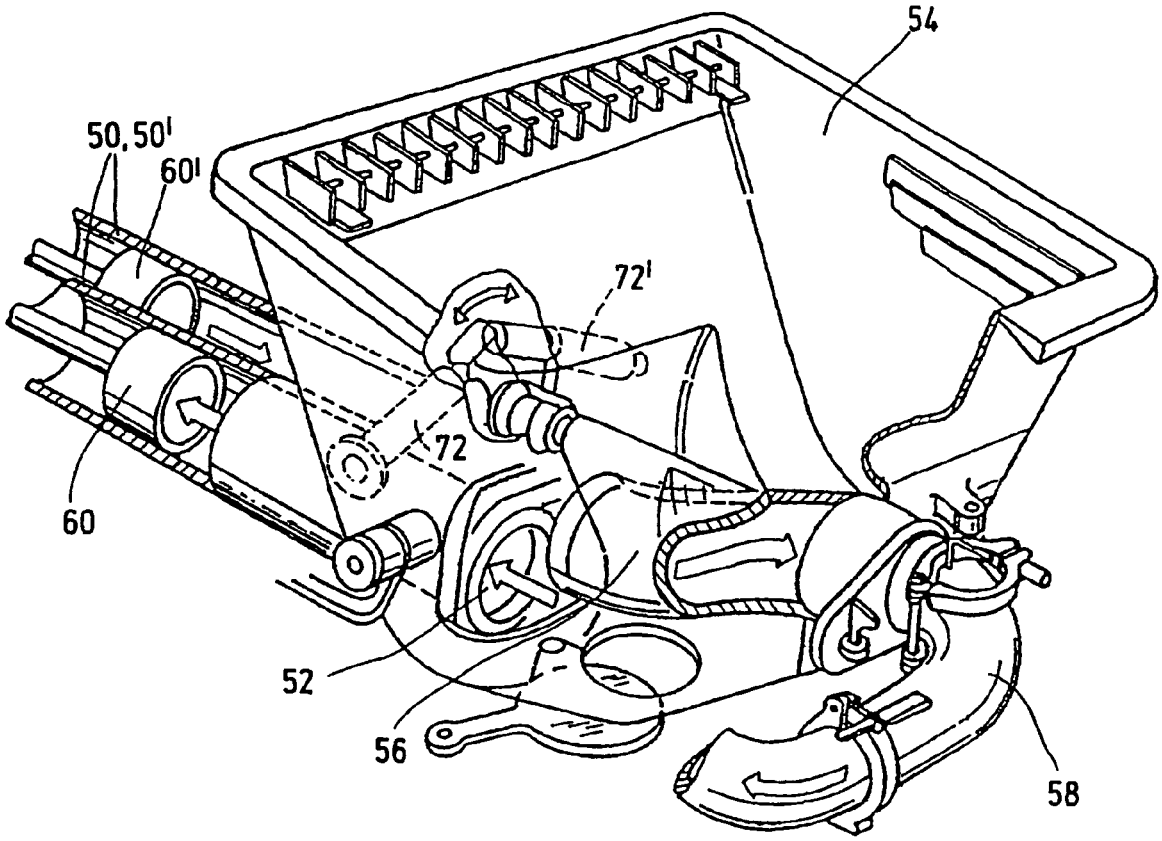
Figure 2:
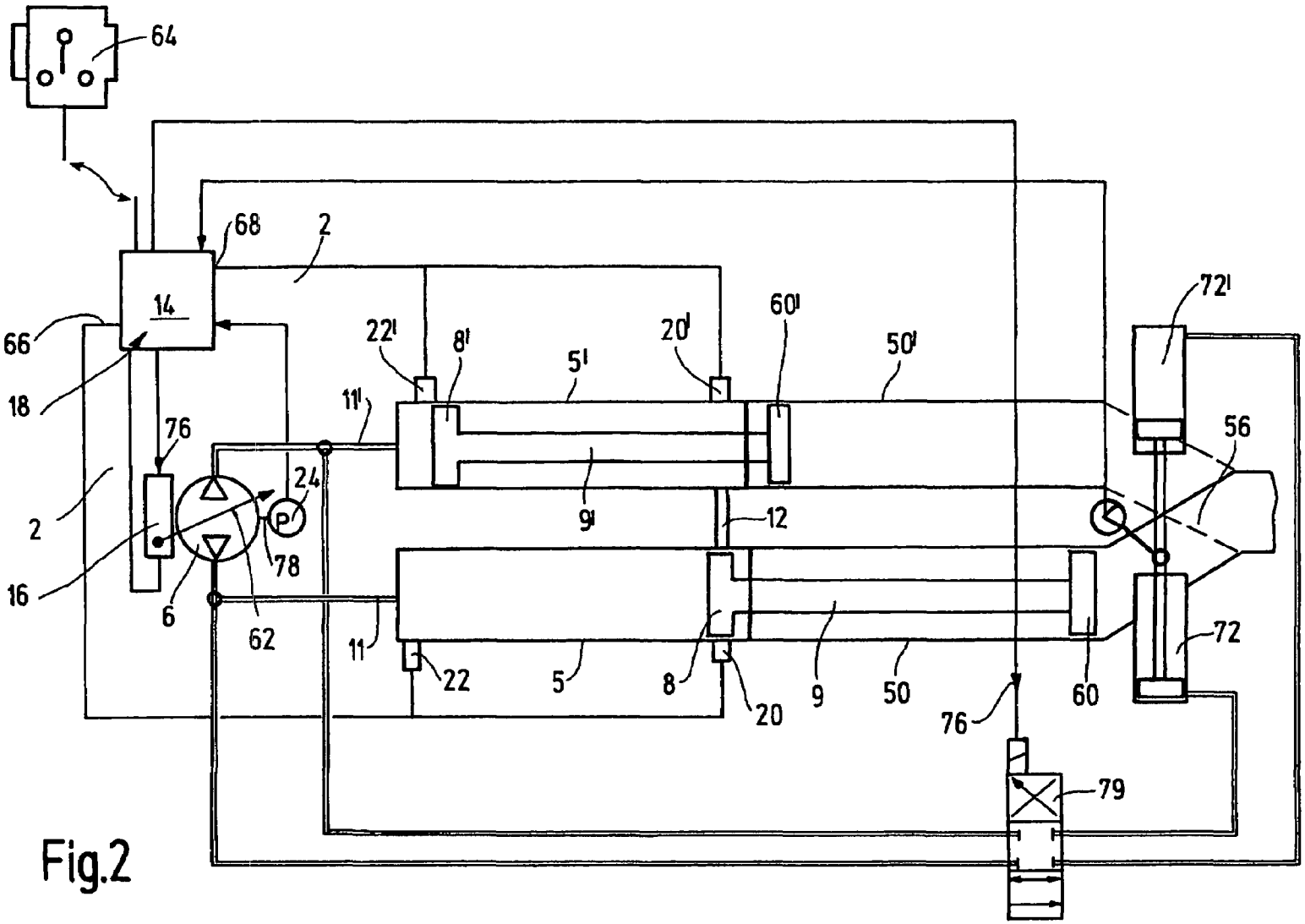
FIG. 2 A circuit diagram of a computer assisted drive hydraulic for a two cylinder thick matter pump.

The control arrangement shown in FIG. 2 is intended for a thick matter pump according to FIG. 1, which includes two conveyor cylinders 50, 50' of which the end openings 52 communicate in a material supply container 54 and alternatingly during the pressure stroke can be connected with a conveyor line 58 via a pipe switch 56. The conveyor cylinders 50, 50' are operated in counter-stroke via hydraulic drive cylinders 5, 5' and a reversing hydraulic pump 6. For this purpose the conveyor pistons 60, 60' of the conveyor cylinder 50, 50' are connected with a piston 8, 8' of the drive cylinder 5, 5' via a common piston rod 9, 9'.

In the shown illustrative embodiment the drive cylinders 5, 5' are acted upon with hydraulic pressure on their base side via hydraulic lines 11, 11' of the hydraulic circulation with the aid of the reversible pump 6 and are on their rod side end connected hydraulically with each other via an oscillating oil line 12. The direction of movement of the drive pistons 8, 8' and therewith the common piston rods 9, 9' are reversed when the flow-through direction of the reversible pump 6 is reversed via a reversing device 18 comprising a computer 14 and a switch mechanism 16. The reversible pump 6 has, for this purpose, a slant disk 62, which for reversing is pivoted through its zero position, so that the oil pressure in the hydraulic lines 11, 11' is reversed. The amount conveyed via the reversible pump 6 can be varied, while keeping constant a predetermined rotational speed of a not shown drive motor, by changing the pivot angle of the slant disk 62. The pivot angle of the slant disk 62 can therein be adjusted via a remote control device 64 with support of a computer 14.

Figure 3:
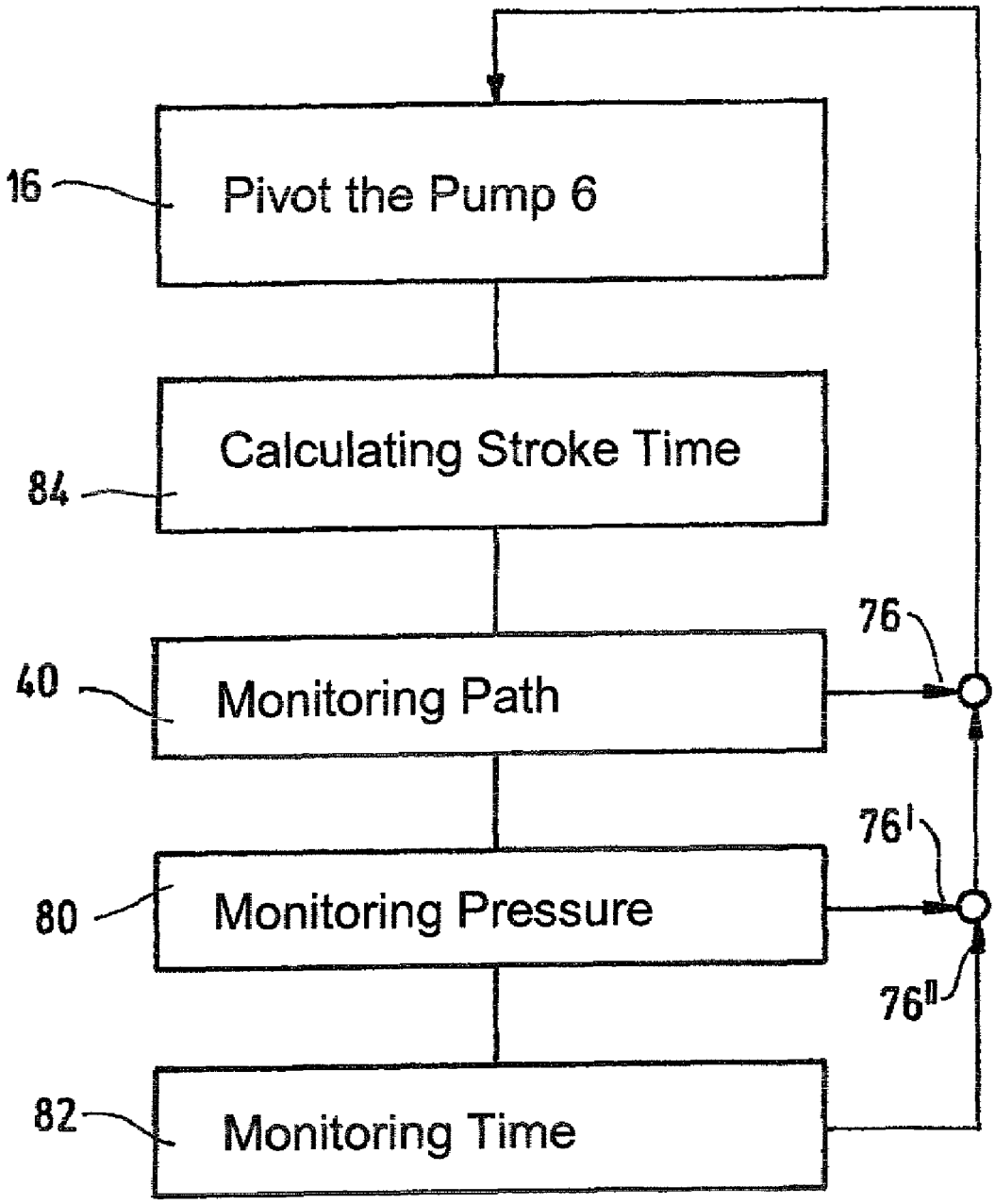
FIG. 3 A flow diagram of a redundant program sequence for the pump control.

The reversing of the reversible pump and the pipe switch 56 occurs as soon as the piston 8, 8' of the drive cylinders 5, 5' reach their end position. The reversing control device 18 exhibits for this purpose multiple redundant control routines, which are integrated with each other to form a hierarchical structured program sequence (See FIG. 3).

The reversing device evaluates output signals of the respective cylinder sensors 20, 22 and 20', 22', located respectively a distance from the rod side and base side ends of the two drive cylinders 5', 5', which on the output side are connected with the computer 14 of the control device 18. The cylinder switch sensors react to the drive pistons 8, 8' passing by during operation of the pump, and signal this occurrence to the computer input 66, 68. Upon occurrence of the output signals a reverse signal 76 is initiated in the reversing device, which reverses the reversible pump 6 via the actuating mechanism 16. In the course of the reverse process there is initiated, besides this, a switching of the pipe switch 56 via the directional valve and the plunger cylinder 72, 72'. In normal operation it is primarily the signals of the rod side cylinder switch sensors 20, 20' which are employed for producing a reverse signal. For this, the computer 14 includes a path monitoring routine 40, in which the output signal of the rod side cylinder switch sensors 20, 20' are evaluated with formation of a switching or reversing signal 76 for the reversible pump 6 and/or the pipe switch 56. In the case that at least one of the rod side cylinders switch sensors 20, 20' fails, at least one of the base side cylinder switch sensors 22, 22' is activated in the place of the failed sensor for forming the reverse signal 76 via the monitoring routine 40.

The switching or reversing device 18 further includes a pressure sensor 24, which is connected on the high pressure side 78 of the reversible pump 6 and of which the output signal is evaluated in the computer 14 with the aid of a pressure monitoring routine 80. The pressure monitoring routine 80 determines in the course of a stroke displacement an average high pressure and includes an algorithm for determining a pressure increase occurring at the end of each conveyance stroke and for the conversion thereof into a reverse signal 76' for the reversible pump 6 and/or the pipe switch 56. This reversing signal is preferably used for reversing in the case of a failure of the cylinder switch sensors 20, 20'; 22, 22'.

Further, in the case of the calibration of the concrete pump, a stroke duration can be determined depending upon the conveyed amount and drive RPM of the reversible pump 6, and this information be recorded in the memory or data storage of the computer 14. Also, during the pump operation the stroke duration can be measured and recorded via the rod side and base side cylinder switch sensors 20, 20'; 22, 22' depending upon the input amount to be conveyed and the motor RPM. If, in addition thereto, after each reversal process the stroke time is monitored and compared with the recorded stroke duration, a reverse signal 76" for the reversible pump 6 and/or the pipe switch 56 can be derived therefrom, via a stroke monitoring routine 82 of the computer 14. The comparison routine 82 preferably includes an algorithm, which also makes possible a conversion of the stored stroke duration in the case of a change in the conveyed amount and/or the motor RPM. With the therefrom derived reversal signal 76" it is ensured, that also in the case of a failure of the cylinder switch sensors 20, 20'; 22, 22' and pressure sensor 24 or, in the case of the absence of these sensors, an automatic reversing of the reversible pump 6 and the pipe switch 56 can be initiated.

In the described reversing device there can be interconnected with each other to form a redundant, priority structured program sequence (FIG. 3) the monitoring routine 40 responding to cylinder switch sensors 20, 20'; 22, 22', the pressure monitoring routine 80 responsive to the pressure sensor 24, and the time monitoring routine 82 monitoring the stroke time, in this sequence. The triggering of the reversal process occurs via one of the three routines of the program sequence. Besides this, in the program block 84, after each reversal process the stroke time is monitored and in certain cases a new stroke duration is recorded.

In summary the following can be concluded: The invention relates to a device and a method for controlling a two-cylinder thick matter pump comprising conveyance pistons that are actuated in a push-pull manner by means of a hydraulic reversible pump 6 and hydraulic drive cylinders controlled by said pump. For each pressure stroke, the conveyance cylinders 50, 50' are connected to a conveyance conduit 58 by means of a pipe switch 56. At the end of each conveyance stroke in the conveyance cylinders 50, 50', a reversal process of the pipe switch 56 and the reversible pump 6 is triggered. The aim of the invention is to ensure a reliable operation of the pump, even in the event of a breakdown of switch and pressure sensors 20, 22, 24. To this end, during the calibration of the concrete pump and/or during the operation of the pump, the actual length of the stroke of the pistons 8, 81 in the drive cylinders 5, 5' is measured and recorded as expected value, the stroke time of each conveyance stroke is monitored and compared with the expected stroke duration, and the reversible pump 6 is respectively pivoted, reversing the flow, and/or the pipe switch 56 is reversed, when the stroke time exceeds the expected stroke duration by a pre-determined value. The output signals of a pressure sensor 24 connected to the reversible pump 6 or cylinder switching sensors 20, 20' arranged on the working cylinders can also be evaluated in order to trigger a reversal process.

The invention claimed is:

1. A thick matter pump with two conveyor cylinders (50, 50') communicating via two end openings (52) in a material supply container (54), the two conveyor cylinders (50, 50') operated in counter stroke by a hydraulic reversible pump (6) via hydraulic drive cylinders (5, 5') driven by said pump, with a hydraulically actuated pipe switch (56) provided within the material supply container (54), the pipe switch having an inlet and an outlet, the pipe switch inlet being alternatingly connectable to one of the openings (52) of the conveyor cylinders (50, 50'), freeing the respective other opening of the conveyor cylinders (50, 50'), and the pipe switch outlet being connected with a conveyor conduit (58), wherein the drive cylinders (5, 5') are each hydraulically connected at one end with an opening of the reversible pump (6) via respectively one hydraulic line (11, 11'), and wherein the drive cylinders (5, 5') on their other end are connected to each other via an oscillating oil line (12), and further comprising a reversing device (18) for reversing the reversible pump (6) after the conclusion of each piston stroke, wherein the reversing device includes a computer assisted routine (84, 82) for determining an expected stroke duration and for the recording thereof in a data storage as well as for monitoring the time during each piston stroke, and initiating a reversal of at least one of (a) the pipe switch (56) and (b) the flow through reversal of the reversible pump (6) based on a comparison of the value of an elapsed stroke time with the expected stroke duration.

2. The thick matter pump according to claim 1, wherein the reversing device (18) includes a time monitoring routine (82), which includes an algorithm for determining a comparison value of stroke time and expected stroke duration and, in the case of determining an exceeding of a predetermined value, for the conversion of the determination of exceeding of a predetermined value into a reversal signal (76") for the reversible pump (6) and/or the pipe switch (56).

3. The thick matter pump according to claim 1, wherein the thick matter pump control device is calibrated by measuring the actual thick matter conveyed amount and the drive RPM of the reversible pump; and wherein the stroke duration is also measured during calibration, and the measured thick matter conveyed amount, the drive RPM of the reversible pump and the corresponding stroke duration are recorded in the memory of the computer (14) of the reversing device (18).

4. The thick matter pump according to claim 1, wherein the reversing device (18) includes a computer routine for converting or translating the recorded stroke duration in response to a conveyance amount.

5. The thick matter pump according to claim 1, further comprising at least one sensor (24) for monitoring the hydraulic pressure on the high pressure side (78) of the reversible pump (6), of which the output signal is evaluated with a pressure monitoring routine (80) of the reversing device (18) for initiating a pipe switch reversal and/or a flow-through reversal of the reversible pump (6).

6. The thick matter pump according to claim 5, wherein the pressure monitoring routine (80) includes an algorithm for determining a pressure increase occurring at the end of each pressure stroke on the high pressure side (78) of the reversible pump (6), and for the conversion thereof into a reversing signal (76') for the pipe switch (56) and/or the reversible pump (6).

7. The thick matter pump according to claim 1, wherein spaced apart from the rod end and pump end of the drive cylinder (5, 5') respectively one cylinder switch sensor (20, 20'; 22, 22') is provided responsive to a passing piston (8, 8'), and that the reversing device (18) includes a path monitoring routine (40) responsive to the output signal of selected cylinder switch sensors for reversing the pipe switch (56) and/or for initiating a flow-through reversal of the reversible pump (6).

8. The thick matter pump according to claim 7, wherein the reversing device (18) includes a measurement routine (84) for determination of stroke duration from the output signals of the cylinder switch sensors (20, 20'; 22, 22') and for the recordation thereof.

9. The thick matter pump according to claim 7, wherein the path monitoring routine (40) responsive to the selected cylinder switch sensors (20, 20'), the pressure monitoring routine (80) responding to pressure sensors (24) and the time monitoring routine (82) responsive to the stroke times form a program sequence for redundant reversal of the pipe switch (56) and/or the reversible pump (6).

10. The thick matter pump according to claim 3, wherein the input of at least one set target conveyance amount is via a remote control device (64).

11. The thick matter pump according to claim 4, wherein the conveyance amount is set in a remote control device (64).

12. A device for controlling a thick matter pump with two conveyor cylinders (50, 50') communicating with two end openings (52) in a material supply container (54), operated in counter stroke via a hydraulic reversible pump (6) and via hydraulic drive cylinders (5, 5') having pump ends and rod ends and driven by the hydraulic reversible pump (6), with a hydraulically operated pipe switch (56) provided within the material supply container (54), the pipe switch having an inlet and an outlet, the pipe switch inlet being alternatingly connectable to one of the openings (52) of the conveyor cylinders (50, 50'), freeing the respective other opening of the conveyor cylinders (50', 50), and the pipe switch outlet being connected with a conveyor conduit (58), wherein the drive cylinders (5, 5') are each hydraulically connected at their pump end with an opening of the reversible pump (6) via respectively one hydraulic line (11, 11'), and the drive cylinders (5, 5') are hydraulically connected to each other at their rod ends via an oscillating oil line (12), with at least two cylinder switch sensors (20, 20'; 22, 22') in predetermined separation from each other and from the rod and/or pump ends of the drive cylinder (5, 5') responding to the passing by of a piston (8, 8') of the drive cylinder, and with a computer assisted reversal device (18) responsive to the output signal of selected cylinder switch sensors for switching or reversing the reversible pump and the pipe switch (56) after completion of a piston stroke, characterized by at least one sensor for monitoring the hydraulic pressure on the high pressure side (70) of the reversible pump (6) of which the output signal can be evaluated with a pressure monitoring routine (80) of the computer assisted reversal device (18) for initiating at least one of (a) a reversal of the pipe switch (76) and (b) a flow-through reversal of the reversible pump (6).

13. A process for controlling a thick matter pump with two conveyor cylinders (50, 50') of which two end openings (52) are in communication in a material supply container (54), operated in counter stroke via a hydraulic reversible pump (6) and via hydraulic drive cylinders (5, 5') driven by the hydraulic reversible pump (6), with a pipe switch (56) provided within the material supply container (54), the pipe switch having an inlet and an outlet, the pipe switch inlet being alternatingly connectable to one of the openings (52) of the conveyor cylinders (50, 50'), freeing the respective other opening of the convey or cylinders (50, 50'), wherein respectively upon ending of a conveyance stroke in the conveyor cylinders (50, 50') a reversal process of the pipe switch (56) and/or the reversible pump (6) is initiated, said process comprising:

measuring and recording, during calibration of the concrete pump and/or during the pump operation, the stroke duration of the piston (8, 8') in the drive cylinders (5, 5') and recording this in memory as the expected stroke duration, monitoring during each conveyance stroke the stroke time and comparing monitored stroke time with the expected stroke duration, and reversing the reversible pump (6) with reversal of the flow-through and/or pivoting the pipe switch (56) to the alternate opening when the stroke time exceeds the expected stroke duration by a predetermined value.

14. The process according to claim 13, wherein the recorded stroke duration is converted proportional to output, depending upon a predetermined conveyance amount for the comparison with the actual stroke time.

15. The process according to claim 13, wherein during the pump process the hydraulic pressure is monitored on the pressure side (78) of the reversible pump (6), and that a pressure increase measured at the end of one of each piston strokes is evaluated for formation of a reverse signal for the reversible pump (6) and/or the pipe switch (56).

16. A process according to claim 13, wherein during the pumping process the passing by of the piston (8, 8') at cylinder switch sensors (20, 20'; 22, 22') associated with the hydraulic drive or conveyor cylinder (5, 5'; 50, 50') is recorded and evaluated for determining a reverse signal for the reversible pump (6) and/or the pipe switch (56).

17. A process according to claim 16, wherein the output signals of two cylinder switch sensors (20, 20') provided spaced apart from each other are evaluated for determining a stroke duration and evaluated for recording subsequent to each piston stroke.

18. A process according to claim 16, wherein the output signals (76, 76', 76") of the cylinder switch sensors (20, 20'; 22, 22'), a pressure monitoring sensor (24) and the stroke time/stroke duration comparison (82) are used for redundant initiation of a reversing process of the reversible pump (6) and/or pipe switch (56).

19. A process for controlling a thick matter pump with conveyor cylinders (50, 50') of which two end openings (52) are in communication in a material supply container (54), operated in counter stroke via a hydraulic reversible pump (6) and via hydraulic drive cylinders (5, 5') driven by the hydraulic reversible pump (6), with a hydraulically operated pipe switch (56) provided within the material supply container (54), the pipe switch having an inlet and an outlet, the pipe switch inlet being alternatingly connectable to one of the openings (52) of the conveyor cylinders (50, 50'), freeing the respective other opening of the conveyor cylinders (50', 50), and the pipe switch outlet being connected with a conveyor conduit (58), the process comprising:

initiating, respectively upon ending of a conveyance stroke in the conveyor cylinders, a reversal process of the pipe switch (56) and/or the reversible pump (6), monitoring during the pump process the hydraulic pressure of the reversible pump (6), and evaluating a pressure increase measured at the end of each piston stroke and converting the pressure increase into a reverse signal (76) for the reversible pump (6) and/or the pipe switch (56).

* * * * *